United States Patent [19]

Tosini et al.

[11] Patent Number: 5,074,354

[45] Date of Patent: Dec. 24, 1991

[54] CASTING METHOD FOR A CONTINUOUS CASTING MACHINE OF A REDUCED HEIGHT AND CONSEQUENTIAL IMMERSED TEEMING NOZZLE

[75] Inventors: Riccardo Tosini, Udine; Alfredo Bassarutti, Terenzano-Pozzuolo del Friuli, both of Italy

[73] Assignee: Danieli & C. Officine Meccaniche SpA, Buttrio, Italy

[21] Appl. No.: 547,307

[22] Filed: Jul. 3, 1990

Related U.S. Application Data

[62] Division of Ser. No. 238,301, Aug. 31, 1988.

[30] Foreign Application Priority Data

| | | | |
|---|---|---|---|
| Sep. 7, 1987 | [IT] | Italy | 83452 A/87 |
| Nov. 5, 1987 | [IT] | Italy | 83488 A/87 |
| Jul. 29, 1988 | [IT] | Italy | 83463 A/88 |

[51] Int. Cl.[5] ..... B22D 11/00; B22D 41/58

[52] U.S. Cl. ..... 164/453; 164/475; 164/489; 222/603

[58] Field of Search ..... 164/437, 438, 439, 415, 164/488, 489, 475, 337, 256, 257, 453; 222/591, 603, 606, 607

[56] References Cited

U.S. PATENT DOCUMENTS

| | | | |
|---|---|---|---|
| 2,379,401 | 6/1945 | Poulter | 164/63 |
| 2,544,598 | 3/1951 | Kalina | 164/257 |
| 2,734,241 | 2/1956 | Southern | 164/256 |
| 4,588,112 | 5/1986 | Kondo | 164/475 |
| 4,749,025 | 6/1988 | Nonini | 164/468 |

FOREIGN PATENT DOCUMENTS

| | | | |
|---|---|---|---|
| 2609769 | 6/1977 | Fed. Rep. of Germany | 164/437 |
| 3331575 | 3/1985 | Fed. Rep. of Germany | 164/437 |
| 2541915 | 9/1984 | France | 164/488 |
| 884844 | 11/1981 | U.S.S.R. | 164/475 |
| 1282954 | 1/1987 | U.S.S.R. | 164/475 |
| 1166334 | 10/1969 | United Kingdom | 164/459 |

*Primary Examiner*—Richard K. Seidel
*Assistant Examiner*—Rex E. Pelto
*Attorney, Agent, or Firm*—Wegner, Cantor, Mueller & Player

[57] ABSTRACT

A continuous casting method of a reduced height with a horizontal or almost horizontal oscillating crystallizer, whereby an immersed teeming nozzle teems molten metal into the crystallizer below the meniscus, regulation of the flow being obtained with regulation means corresponding to the formula: $V \geqq K \cdot \sqrt{2gh - 2p/\rho}$, a pressure being kept within a tube portion of the teeming nozzle at least transiently which is correlated with the pressure surrounding the teeming nozzle itself and with the pressure acting on the meniscus of the molten metal in the crystallizer, the pressure within the tube portion of the teeming nozzle being such as will at least hinder the migration of gas from the exterior of the nozzle to the inside of the bore of the tube portion.

10 Claims, 4 Drawing Sheets

CASTING METHOD FOR A CONTINUOUS CASTING MACHINE OF A REDUCED HEIGHT AND CONSEQUENTIAL IMMERSED TEEMING NOZZLE

This application is a continuation of Ser. No. 07/238,301, filed Aug. 31, 1988.

This invention concerns a method for casting molten metal in a continuous casting machine of reduced height, and also concerns an immersed nozzle to teem molten metal within a crystallizer of a continuous casting machine of a reduced height, the nozzle enabling this method to be performed.

To be more exact, the method concerns a continuous casting method and a consequential immersed nozzle to teem molten metal, the nozzle being positioned below a tundish and serving to feed molten metal into the crystallizer of a continuous casting machine of a reduced height, that is, of a horizontal or almost horizontal type, the outflow hole of the teeming nozzle being located below the meniscus of the molten metal in the crystallizer.

A continuous casting machine of a reduced height, namely with a horizontal or almost horizontal crystallizer, is a continuous casting machine in which the inlet of the crystallizer is positioned below a substantially horizontal line passing through the generating center of the "Rm" (mean radius) of the crystallizer itself and substantially parallel to the line of extraction of bars; this means that the inlet of the crystallizer is located below that horizontal line by an angle having a value "alpha" greater than zero.

The invention can be applied correctly at values of "alpha" as low as about 5° and the importance of the invention increases progressively as the value of "alpha" increases.

A continuous casting machine of a reduced height normally entails a value of "alpha" between 30° and 45°.

A continuous casting machine of a reduced height is disclosed, for instance, in U.S. Pat. No. 4,749,025 in the name of the present applicant.

A crystallizer suitable for such a machine is disclosed, for instance, in EP-A-86202132.6 in the name of the present applicant and is shown in the diagram of FIG. 1, which illustrates an almost horizontal continuous casting crystallizer, the inlet of which (the center of the inlet corresponds with the position of the "Rm") lies at an angle "alpha" having a value of about 45°.

Continuous casting machines of a reduced height are also disclosed in CH 403172 and in PCT/WO 8102990.

The continuous casting machines of a reduced height to which this invention refers have their crystallizer provided with an oscillatory motion, whereas the tundish is stationary.

Continuous casting machines with a horizontal or almost horizontal oscillatory crystallizer of the state of the art, although they provide a plurality of advantages as regards to investments, volumes occupied, height of production sheds, maintenance costs, safety, etc. are not employed for high quality steels mainly because the product obtained is not fully satisfactory in quality as compared to the present standards required by users.

This unsatisfactory quality results from the fact that the bars produced with horizontal or almost horizontal crystallizers include a build-up of non-metallic inclusions or of gas in the part corresponding to their upper inner curved side, that is, in the resulting upper face of the bar.

So as to understand the situation regarding inclusions in their upper inner curved side, it is necessary to bear in mind that during the continuous casting process, a certain quantity of non-metallic inclusions (for instance, large inclusions of alumina, products of chemical reactions between steel and refractories, particles of refractories detached by erosion, products of reoxidation of the steel, particles of slag and, above all, gas) becomes separated by floating from the stream of steel passing through the tundish and reaching thereafter the crystallizer of the ingot mould.

The inclusions in the tundish are mostly absorbed by the slag above them, but a certain amount of the inclusions is conveyed into the ingot mould.

In vertical machines or in traditional curved machines of a large radius for large blooms the inclusions are wholly or mostly absorbed by the liquid slag or, in the case of gas, released into the atmosphere.

In continuous casting machines of a greatly reduced height, that is, with a horizontal or almost horizontal crystallizer, complete separation of the inclusions is most unlikely since the ingot mould is tilted and a part of such inclusions reaches the crystallizer during the ascending movement of the latter.

This problem increases progressively with increases in the angle "alpha" but already makes its presence felt with an angle "alpha" of about 5°.

For the above reason, any material lighter than steel and, even more so, the gases which enter the ingot mould together with the steel are deposited firstly on the upper inner curved side of the mould during its ascending movement and are then held in the upper inner curved side of the cast bar. This situation is shown in FIG. 2.

This effect can be partly, but not sufficiently, lessened by adjusting the geometric characteristics of the teeming nozzle and by reducing the speed of extraction of the bar.

So as to provide a more satisfactory mechanism for separating and, in particular, for at least reducing the gases which enhance the trapping and entraining of the inclusions in depth, the present applicant has tested and obtained the method according to the invention.

The formation of gas in the molten metal passing through the teeming nozzle is caused by dynamic and hydrodynamic factors since a negative pressure is brought about within the bore of the tube portion of the nozzle in the state of the art at least during opening of the nozzle, that is to say, during starting of the teeming.

This negative pressure tends to suck air from the exterior of the nozzle towards the inside of the bore of the same and to release the gases already included in the molten metal with accumulative effect.

In normal continuous casting machines, where the crystallizer is positioned substantially vertically or with a very small angle "alpha", this occurrence is only sometimes damaging, since it is only when the speed of withdrawal of a bar is very high that any gas included or becoming included in the molten metal cannot reascend into the molten bath held within the crystallizer.

Instead, in continuous casting machines of a reduced height, where the crystallizer is substantially horizontal or almost horizontal, this occurrence becomes a constantly unfavourable factor since it becomes substantially impossible for natural evacuation of the gases and inclusions contained in the molten metal and carried into the crystallizer to take place.

These gases form bubbles which become concentrated on the upper inner curved side of the crystallizer and lead to a severe deterioration of product quality.

FR 2.541.915 discloses a teeming nozzle with an outlet hole much smaller than the bore of its tube portion; in this case the regulation is performed not by acting on the closure and regulation stopper but by acting only on the speed of extraction of the cast bar. In this document the closure stopper is used only in an emergency.

In this document the nozzle teems the molten metal below the meniscus in the crystallizer, and the crystallizer is of a vertical type or for use with tall machines.

GB 1,157,818 discloses an encased teeming nozzle with an outflow hole smaller than the bore of the tube portion of the nozzle; this nozzle teems the molten metal above the meniscus of the molten metal in the crystallizer. In this case too the crystallizer is of a type for vertical, tall continuous casting machines or is of a type occupying a substantially full quarter of a circle.

U.S. Pat. No. 2,734,241 discloses a system for continuous casting in a vacuum in vertical continuous casting machines, in which the crystallizer is stationary.

U.S. Pat. No. 2,379,401 discloses a casting system that employs a vacuum.

To obviate the above drawback, which is so typical of continuous casting machines of a reduced height, the present applicant has studied, tested and obtained a method for the continuous casting of molten metal in an oscillatory crystallizer of a continuous casting machine of a reduced height independently of the system of regulation of the flow of molten metal through the nozzle, for such regulation can be achieved by using any of the following systems:

by an adjustable choking system upstream of the teeming nozzle (stopper, slide valve closure, etc.);

by regulation of the speed of extraction of the bar;

by regulation of the depth of the molten metal in the tundish;

or else by combining two or more of the above systems.

The applicant has also designed and embodied a teeming nozzle that enables the method to be performed, the nozzle teeming the molten metal below the meniscus in an oscillatory crystallizer of a continuous casting machine of a reduced height.

According to a first embodiment of the invention, the area of the outflow hole of the nozzle must be smaller than the area of the bore of the tube portion of the nozzle.

This means that if the outflow hole and the bore of the tube portion of the nozzle are, for instance, circular, then the diameter "D" of the outflow hole must be smaller than the diameter "d" of the bore of the tube portion.

To be more exact, according to the invention, the selection of the outflow hole should be such that the speed of outflow "V" complies with the equation:

$$V \geqq K \times \sqrt{2gh - 2p/\rho}$$

where:

"V" is the speed of outflow of molten metal from the outflow hole in meters per second;

"K" is a correction coefficient depending on the physical properties of the steel and on the physical and geometric characteristics of the nozzle and the bore of the tube portion of the nozzle;

"h" is the distance in meters between the stopper that regulates the flow and the level of the molten bath in the crystallizer of the mould;

"p" is the difference in pressure in N/m2 between the existing pressure on the meniscus of the molten metal in the crystallizer of the mould and the pressure in the tundish;

"$\rho$" is the density of the molten metal in kgs/m3.

The coefficient "K" for molten steel varies between 0.95 and 0.7; tests have shown that it normally lies between 0.8 and 0.75.

According to a variant the immersed nozzle is, in fact, made fully impermeable.

Such impermeabilization can be obtained with processes to treat or prepare the nozzle or by encasing the nozzle with metallic jackets or by impermeabilizing varnishes.

According to another variant a chamber is created around the nozzle and is kept at the required value of negative pressure.

In the case of nozzles consisting of several pieces the chamber may or may not include the line of union of such pieces.

According to investigations carried out the chamber may be brought to a value approximately equal to the value of negative pressure inside the nozzle.

According to investigations carried out the chamber may also be brought to a value of negative pressure such that any gases in the molten metal passing within the nozzle tend to migrate towards the wall of the nozzle and then to pass through that wall.

In this way a pressure is created within the nozzle, or the method cooperates with a pressure existing within the nozzle, the pressure being such that it assists release of the gases dissolved in the molten bath, so that the negative pressure in the chamber creates a degassing effect in the molten metal passing through.

The invention is therefore obtained with a method for continuous casting with nozzles immersed in the molten metal contained in the oscillatory crystallizer of a continuous casting machine of a reduced height, whereby the regulation of the flow of molten metal can be performed in a plurality of ways according to the features of the relative claims.

The invention is also embodied with an immersed nozzle for continuous casting machines of a reduced height with an oscillatory crystallizer, the nozzle being suitable to carry out the above method and providing the features and contents of the relative claims.

The attached figures, which are given as a non-restrictive example, show the following:

FIG. 1 gives a diagram of a crystallizer for a continuous casting machine of a reduced height, the crystallizer being almost horizontal in this example;

Figure 9:
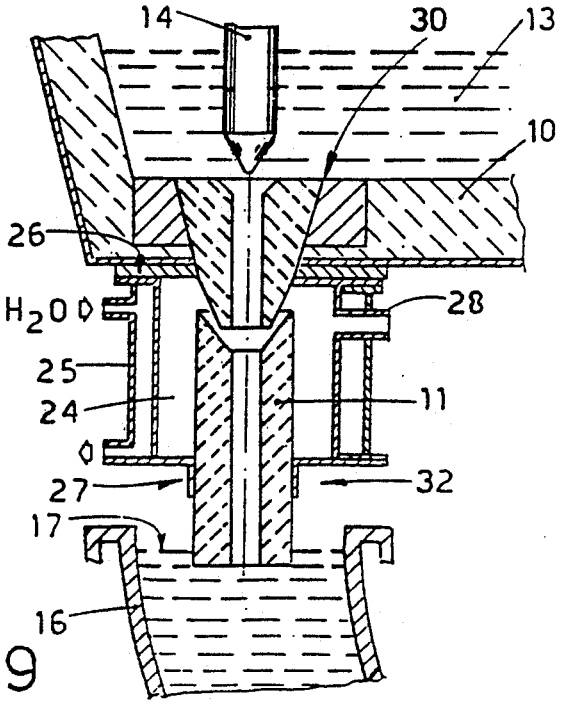
Figure 4B:
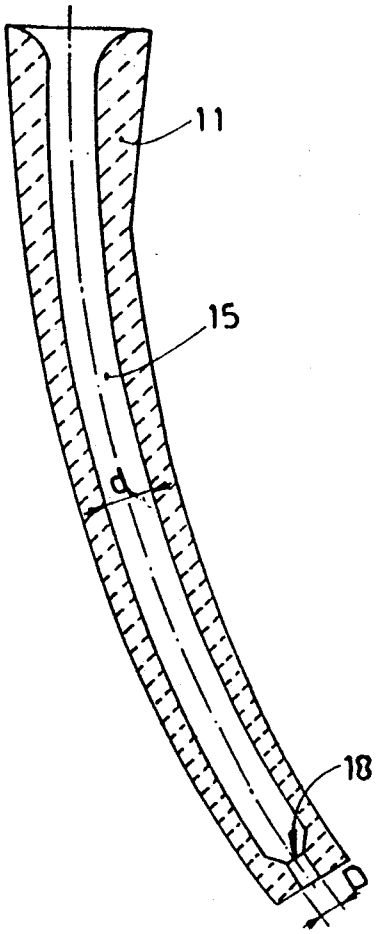
Figure 4A:
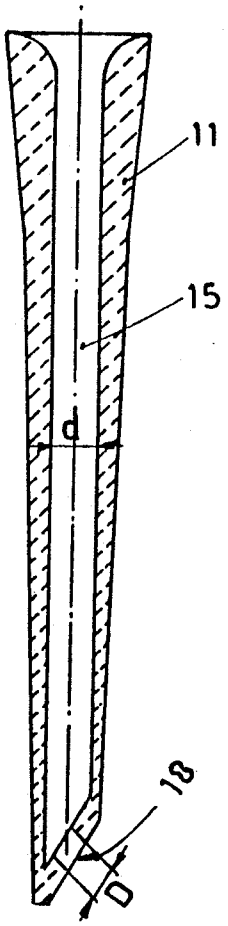
Figure 5:
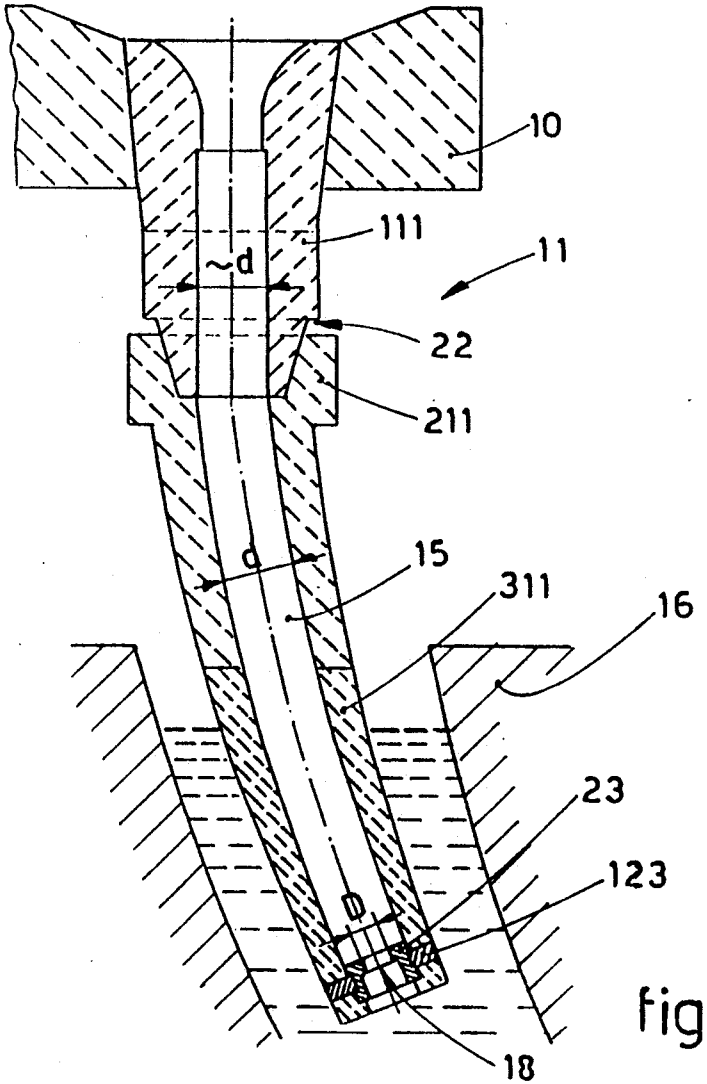
Figure 6:
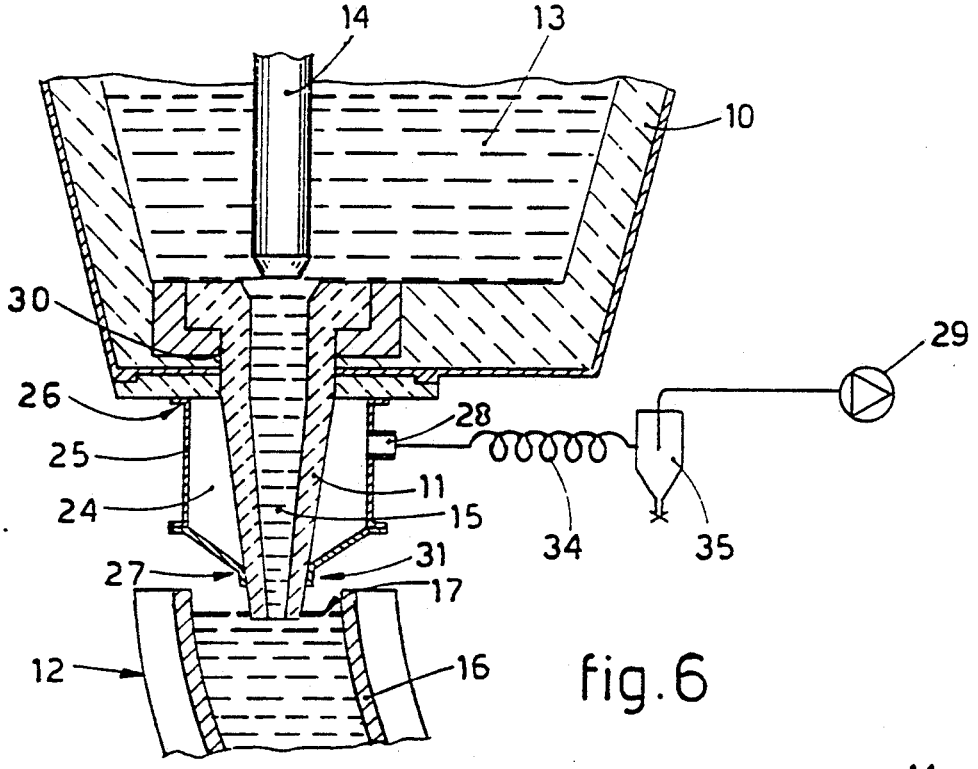
Figure 7:
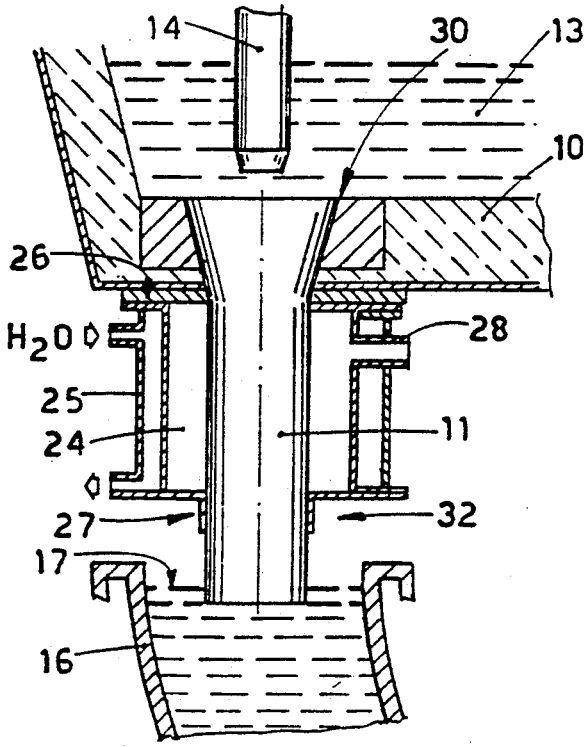
Figure 8:
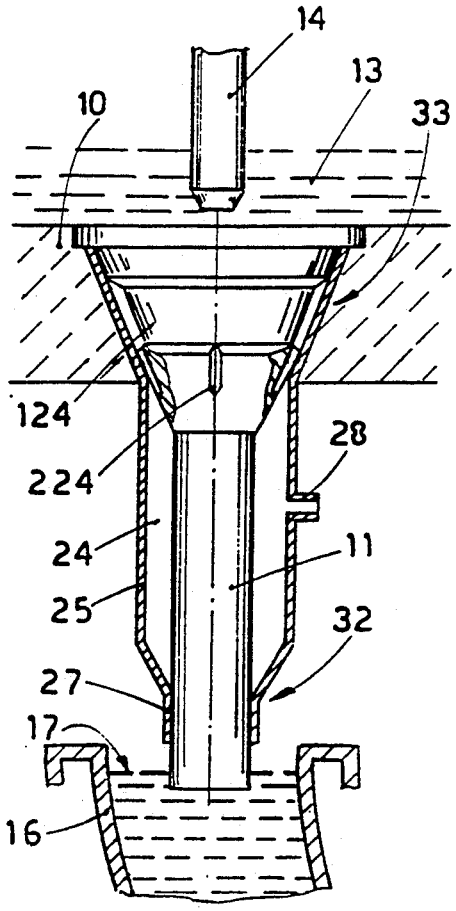

FIGS. 4*a* and 4*b* show two possible teeming nozzles according to the invention;

FIG. 5 shows a two-piece nozzle according to the invention;

FIGS. 6, 7 and 8 show a variant of the embodiment of the invention;

FIG. 9 shows a variant for degassing the molten metal.

Figure 1:
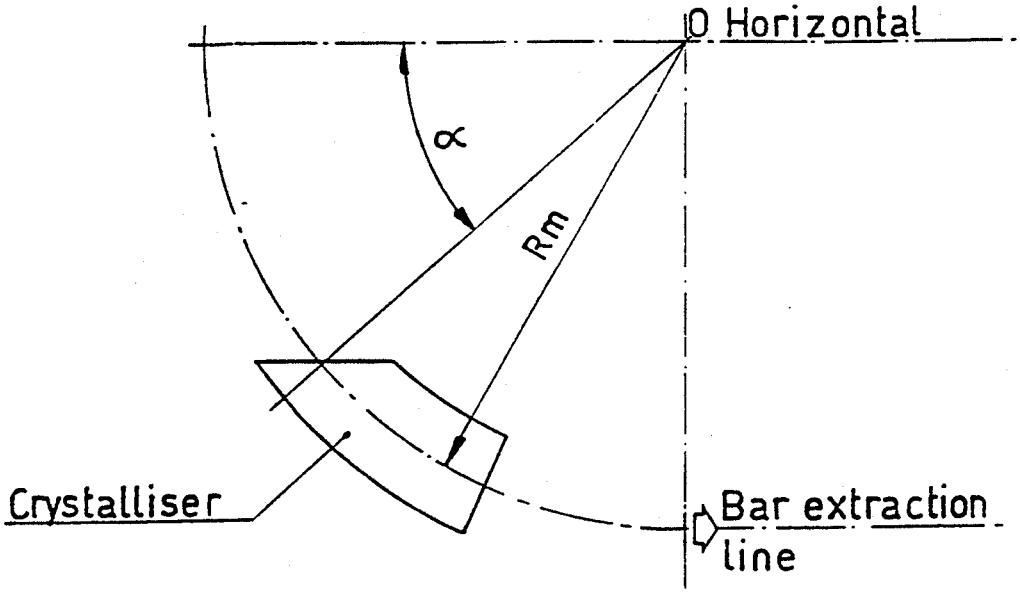
Figure 2:
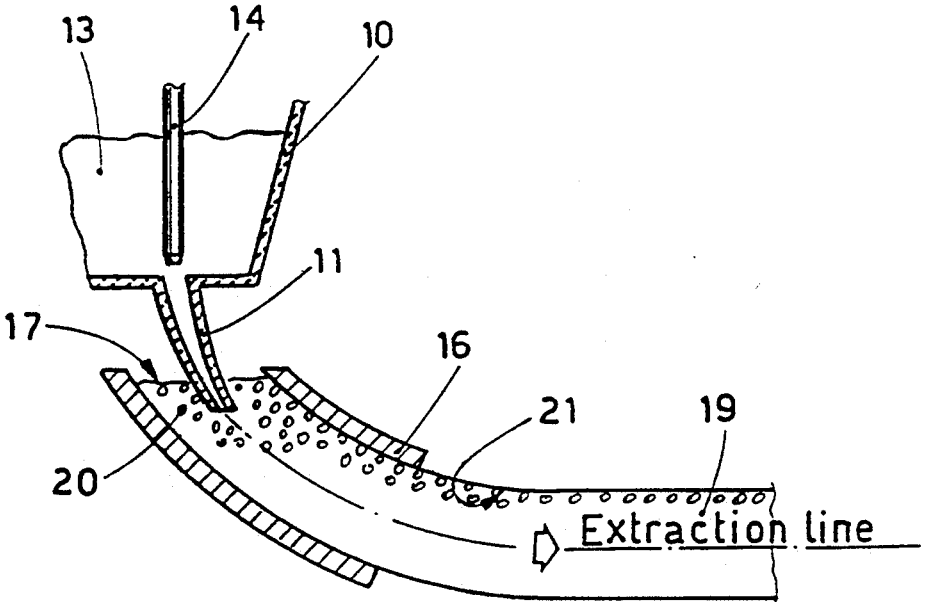
FIG. 2 shows how the non-metallic inclusions and gases behave and where they are deposited in a continuous casting machine of a reduced height.

FIG. 2 shows a tundish 10 with a teeming nozzle 11 that connects the inside 13 of the tundish 10 to the inside of a crystallizer 16.

The nozzle 11 cooperates with means 14 regulating the flow of metal and teems the molten metal below the meniscus 17.

The flow regulation means 14 may be a stopper, as shown in the figures as an example, or a slide valve or other analogous means which cooperate with the tundish, or may condition the control of the level of molten metal in the tundish 10, or else may condition the speed of extraction of the cast bars from the crystallizer 16. They may also result from a combination of two or more of such systems.

A portion of inclusions 20 coming from the nozzle 11 reascends and is removed in the liquid slag or is released into the atmosphere.

Another portion remains on the upper inner side 21 within the crystallizer 16 and becomes incorporated and held in the skin of metal being formed and then becomes part of a bar 19 and is discharged therewith.

Figure 3:
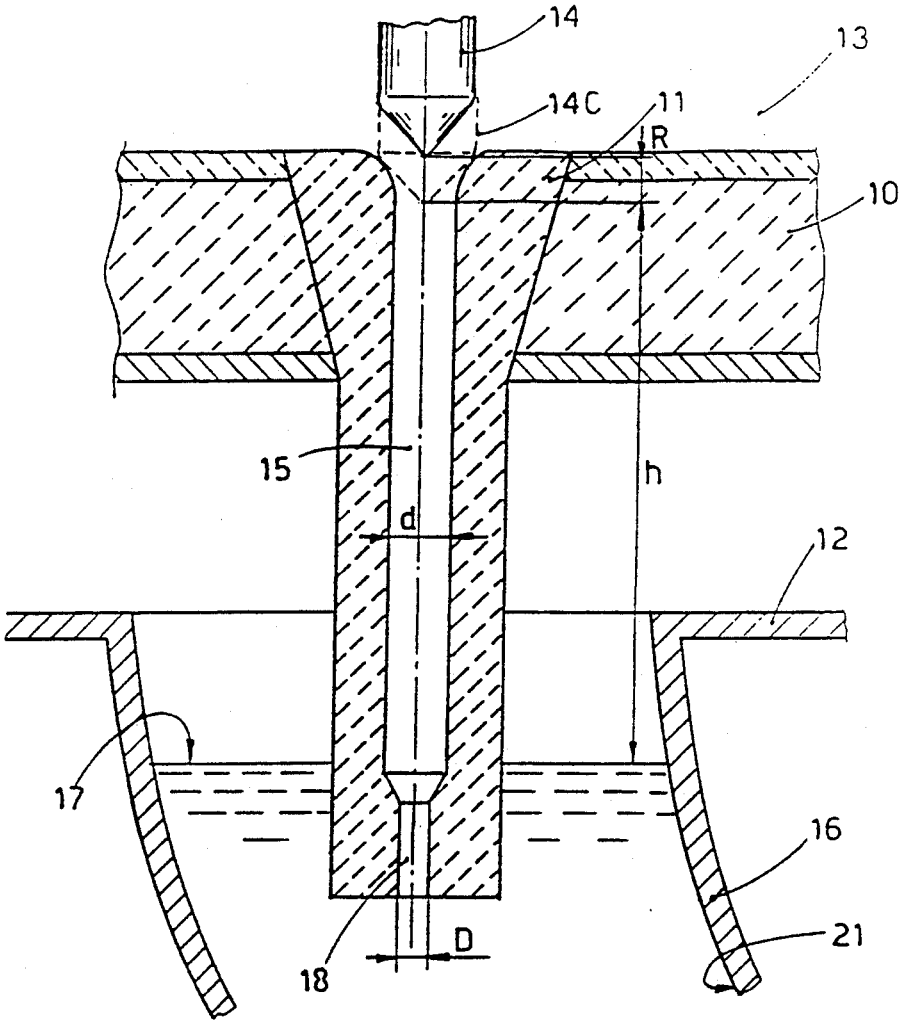
FIG. 3 shows a first embodiment of the invention.

In FIG. 3 a teeming nozzle 11 is located in the bottom of a tundish 10 and serves to connect the inside 13 of the tundish 10 to the inside of the crystallizer 16 of an ingot mould 12.

The nozzle 11 teems the molten metal into the crystallizer 16 below the meniscus 17 formed by the molten metal in the crystallizer 16.

The nozzle 11 cooperates at its upper end with flow regulation means 14, a stopper in this example, which in its position 14C shuts off wholly the flow of molten metal from the inside 13 of the tundish 10 to the inside of the bore of the tube portion 15 of the nozzle 11.

The maximum travel of the regulation means in this example is shown with "R".

The nozzle 11 has a bore of its tube portion 15 with a diameter "d" and one single outflow hole 18 with a diameter "D". Several outflow holes may be included.

The symbols "d" and "D" do not necessarily indicate a circular bore or hole. Moreover, the symbol "D" does not necessarily indicate one single outflow hole, and "d" and "D" may mean any section of passage usable as a bore for the tube portion 15 and as an outflow hole 18.

The distance between the closed position of the stopper 14 and the meniscus 17 constitutes the head "h" of the nozzle 11.

According to the invention the speed "V" of the passage of the molten metal through the outflow hole 18 must comply with the equation:

$$V \geqq K \times \sqrt{2gh - 2p/\rho}$$

FIG. 4 show two nozzles 11 respectively, one of them being straight with an inclined outflow hole 18 (FIG. 4*a*), whereas the other is curved with an axial outflow hole 18 (FIG. 4*b*).

It should be borne in mind that the density of the material constituting the nozzle 11 may vary from the outside to the inside or else may comprise concentric thicknesses of a variable density or may even be made with one single density. Moreover the density may also vary along the length of the nozzle 11.

FIG. 5 shows a nozzle 11 consisting of two parts 111-211 to assist replacement of the part which becomes most easily worn.

The lower part 211 in this example comprises a lower zone 311 having a density and material of composition different from those of the upper zone; this lower zone 311 cooperates with the bath of molten metal in the crystallizer 16.

The two parts 111-211 are connected together with a coupling 22 and appropriate clamping means may be provided.

The outflow hole 18 consists of a gauged nozzle 23, which in this example can be replaced and is clamped with clamping screws 123.

FIGS. 6, 7 and 8 show a variant in which a tundish 10 teems molten metal into the ingot mould 12 through a nozzle 11, which cooperates with the meniscus 17 of the molten metal in the crystallizer 16 of the mould 12.

A chamber 24 cooperates with the nozzle 11 and is defined by a container 25, which in the example of FIGS. 6 and 7 is secured to the lower part of the tundish 10; in this way the action of the negative pressure in the chamber 24 is spread also through connecting lines 30 and porous surrounding materials.

Next, the container 25 is fixed at 27 to the nozzle 11. This fixture 27 may be obtained by cooperation of tapered elements 31 or of cylindrical elements 32.

The seal engagement of the fixture 27 may be enhanced by using cements or other means.

It is possible to dismantle the container 25 into two or more parts.

The container 25 comprises a hole 28 that cooperates with a pump 29 suitable to create the required degree of vacuum. This pump 29 is of a type that creates a negative pressure of a required value, and an heat exchanger 34 with cooling functions and possibly also a dust separator 35 may be positioned between the pump 29 and the chamber 24.

The negative pressure created by the pump 29 in the chamber 24 will be at least such as will balance the negative pressure created within the bore of the tube portion of the nozzle 11.

The container 25 may be at least partially cooled, as provided for in FIG. 7.

According to another variant of the embodiment (FIG. 8) the container 25 forms at least a partial jacket for the nozzle 11 and in this example is fitted together with the nozzle 11 in a seating 33 provided in the tundish 10.

In FIG. 8 a further chamber 124 has been provided and communicates in this example with the main chamber 34 through conduits 224.

Several chambers 24, each independent of the others, may be provided and one of them may have operational characteristics, that is, a value of pressure or negative pressure, different from the others.

By varying the value of the negative pressure in the chamber 24 and by acting suitably on the porosity of the nozzle 11 it is possible to obtain an effect of degassing the gas dissolved in the ladle in the molten metal, thus purifying the molten metal entering the crystallizer of at least a great part of that gas.

FIG. 9 shows a nozzle 11 consisting of two separate parts so as to create one or more rings of communication between the bore of the tube portion 15 of the nozzle and the inside of the chamber 24.

Instead of the communication rings it is possible to provide communication holes or a ring having a very reduced density and a possibly enlarged bore of the tube portion 15 in correspondence with the communication holes or with the ring having a very reduced density.

With the nozzle of FIG. 9, which has a long lower part that will create always a drawing effect and not suckbacks, it is possible to perform degassing of the molten metal passing through.

We claim:

1. A casting method for a continuous casting machine of reduced height having a horizontal or almost horizontal oscillatory crystallizer, comprising:

teeming molten metal into the crystallizer with a teeming nozzle having an end located below a meniscus of the molten metal within the crystallizer;

regulating the flow of molten metal into the crystallizer;

determining a distance "h" between means for regulating the level of molten metal in the crystallizer and the level of molten metal in the crystallizer, determining a difference in pressure "p" between the pressure acting on the meniscus of the molten metal and a pressure in the tundish, determining a density "$\rho$" of the molten metal and determining a correction coefficient "K" depending on physical properties of the molten metal and on physical and geometrical characteristics of the teeming nozzle and the tube portion of the teeming nozzle; and maintaining, at least during initiation of teeming of molten metal, a predetermined pressure within a tube portion of the teeming nozzle which will hinder the migration of gas from outside the teeming nozzle to the tube portion of the teeming nozzle by providing the teeming nozzle with an outflow hole having a diameter which results in:

$$V \geqq K \cdot \sqrt{2gh - 2p/\rho}$$

where:

"V" is a speed at which molten metal flows from the outflow hole, in meters per second;

"K" is said determined correction coefficient;

"h" is said determined distance expressed in meters;

"p" is said determined difference in pressure expressed in $N/m^2$; and

"$\rho$" is said determined density of the molten metal expressed in $kg/m^3$.

2. A method as claimed in claim 1, wherein said predetermined pressure within the tube portion is maintained at a value greater than the pressure surrounding the teeming nozzle so as to enhance release of gases dissolved in the molten metal passing through the teeming nozzle and enhance lateral migration of gases from the immersed teeming nozzle.

3. A casting method as claimed in claim 1, wherein the teeming nozzle is essentially straight, and the outflow hole is inclined.

4. A casting method as claimed in claim 1, wherein the teeming nozzle is curved, and the outflow hole is axially orientated.

5. A casting method as claimed in claim 1, wherein the teeming nozzle comprises two nozzle parts and a coupling means for coupling the nozzle parts together.

6. A casting method as claimed in claim 1, wherein the teeming nozzle comprises a replaceable gauged nozzle having an outflow hole.

7. A casting method as claimed in claim 1, wherein at least a portion of the teeming nozzle is impermeabilized.

8. A casting method as claimed in claim 7, wherein the portion of the teeming nozzle is impermeabilized by acting on the density of material forming the teeming nozzle.

9. A casting method as claimed in claim 8, comprising a liner surrounding the portion of the teeming nozzle which renders the portion impermeable.

10. A casting method as claimed in claim 9, wherein said liner is a metallic container.

* * * * *